US005868198A

United States Patent [19]

Kato

[11] Patent Number: 5,868,198

[45] Date of Patent: Feb. 9, 1999

[54] HEADER PIPES FOR HEAT EXCHANGER

[75] Inventor: Soichi Kato, Saitama, Japan

[73] Assignee: Zexel Corporation, Tokyo, Japan

[21] Appl. No.: 574

[22] Filed: Dec. 30, 1997

[30] Foreign Application Priority Data

Jan. 14, 1997 [JP] Japan ..... 9-004577

[51] Int. Cl.[6] ..... F28D 1/02

[52] U.S. Cl. ..... 165/153; 165/175; 165/906

[58] Field of Search ..... 165/153, 906, 165/175, 149, 173

[56] References Cited

U.S. PATENT DOCUMENTS 5,193,613 3/1993 Wallis ..... 165/906 X

FOREIGN PATENT DOCUMENTS 2353419 4/1975 Germany ..... 165/149

0030962 3/1977 Japan ..... 165/149

244596 9/1992 Japan ..... 165/149

270895 9/1992 Japan ..... 165/149

*Primary Examiner*—Ira S. Lazarus

*Assistant Examiner*—Christopher Atkinson

*Attorney, Agent, or Firm*—Kanesaka & Takeuchi

[57] ABSTRACT

The header pipes 3 and 4 of a heat exchanger 1, wherein each of the header pipes is provided with a plurality of tube insertion holes 9 in a longitudinal direction; the ends of tubes 2 are inserted into the tube insertion holes; the extended portions 3*a* and 4*a* respectively include longitudinally extended portions respectively extending from the portion provided with the tube insertion holes; further, the extended portions are provided with the reinforcing beads 13 respectively. The beads 13, each having a width equal to the opening width of each of the tube insertion holes 9, are pitched substantially equally as the tube insertion holes. Further, the header pipes 3 and 4 are formed by shaping a flat-sheet header pipe material H into pipes having a predetermined diameter.

3 Claims, 7 Drawing Sheets

HEADER PIPES FOR HEAT EXCHANGER

BACKGROUND OF THE INVENTION

1. Field of the Invention

The present invention relates to header pipes for a heat exchanger with tubes connected thereto for heat exchange through a medium and designed to distribute and collect the medium.

2. Description of the Related Art

In general, any conventionally known heat exchanger comprises a plurality of tubes laminated with fins interposed and header pipes disposed at opposite ends of tubes, the header pipes respectively having tube insertion holes into which opposite ends of each tube are inserted respectively to be connected with the header pipes, an inlet joint and an outlet joint respectively connected to a header pipe so that heat exchange can be effected while the heat exchange medium flows by meandering a plurality of times through the tubes disposed between the inlet joint and the outlet joint of the header pipes.

In the header pipe used in this type of heat exchanger, a plurality of tube insertion holes are longitudinally formed by being pitched at predetermined intervals, and the inside of each header pipe is divided by partitions provided at predetermined positions, whereby heat exchange medium is distributed and collected for circulation by units of tube groups.

Such a header pipe is provided with an extended portion longitudinally extending from the portion where tube insertion holes are formed. The extended portion serves for providing the inlet joint and the output joint and also for supporting a bracket for installation of heat exchanger.

However, as shown in FIG. 7, for example, in the case of a conventional heat exchanger 20, for the purpose of using a common mold, common header pipes 21 (only one of them is shown) are used for both the left and right header pipes. As a result, in the header pipe not provided with neither the output joint nor the inlet joint, an extended portion 21*a* extending outside of a side plate 8 which is not provided with either the output joint or the inlet joint.

Such an extended portion as the extended portion 21*a* of the header pipe 21 is much inferior in strength to the portion provided with tube insertion holes 9, 9 and, of such header pipes, those obtained by forming the flat-sheet material into pipes are particularly apt to be deformed or ruptured.

This results from (1) that while the portion having the tube insertion holes is reinforced by being connected to the tubes, the extended portion without the tube insertion holes is not reinforced by the tubes. That is, the end of each tube inserted into the tube insertion hole acts as a reinforcement to resist deformation or internal pressure, so that the portion provided with the tube insertion holes is reinforced by the units of the intervals of the tube insertion holes. On the other hand, such an extended portion, lacking in the reinforcement by being connected to the tubes, is weaker in relative strength.

Further, (2) the peripheral region of each tube insertion hole is formed with a projecting edge (hereinafter referred to as a burring) for the purpose of increasing a brazing area with the end of tube. The portion formed with the tube insertion holes are reinforced with the burring and brazing material deposited on the burring. For this reason, therefore, the header pipe material having a thickness of more than necessary has to be used merely for increasing the strength of such extended portion.

Furthermore, (3) in forming the header pipe by shaping the header pipe material with the tube insertion holes and burrings, the recoiling force (hereinafter referred to as spring back) of the header pipe material can be suppressed to a certain extent due to the existence of the burrings. As a result, there occurs some differences in the spring back between the portion provided with the tube insertion holes and the extended portion without the tube insertion holes, causing an inconvenience such that the opposite ends of the portion provided with the tube insertion holes can be fit snugly along the seam, while the opposite edges of the extended portion are apt to separate along the seam to a degree that the joining along the seam become impossible, or the cap cannot be fitted.

In order to avoid such inconvenience, the material having a thickness large enough to increase the strength of the extended portion has to be used despite that the portion of the header pipe provided with the tube insertion holes need not be formed by using the material of such thickness, causing, as a result, the whole header pipe should be formed using the material having a thickness and rigidity more than necessary.

SUMMARY OF THE INVENTION

The present invention is made in consideration of the forgoing problems, and it is an object of the invention to provide a header pipe having an extended portion with an adequate strength, or capable of securing necessary strength, that can prevent deformation or rupture without being required to have a wall thickness of more than necessary.

The present invention relates to header pipes for heat exchanger, each header pipe being provided with a plurality of longitudinally formed tube insertion holes, and the opposite ends of tubes being inserted into the tube insertion holes, wherein each header pipe has an extended portion longitudinally extending from the portion when the tube insertion holes are formed, and, further, the extended portion is formed with reinforcing beads.

With the structure as described above, the extended portion can be reinforced with the beads to prevent it from being deformed or ruptured. Further, it can be avoided to form each header pipe by using the material having a thickness more than necessary.

Further, preferably, each of the beads has a width substantially equal to a width of each opening width of the tube insertion hole, and the beads are pitched at intervals substantially equal to those of the tube insertion holes.

With such construction, the beads formed with the extended portion provide reinforcing strength substantially equal to those provided for the portion having the tube insertion holes to balance the strength, thereby preventing the deformation or rupture of the extended portion.

The present invention is especially useful when applied to the header pipe to be formed by shaping a flat-sheet header pipe material into a pipe having a predetermined diameter. More particularly, in this type of header pipe, the seam of the extended portion tends to separate due to the effect of the spring back while the material is being shaped into a pipe having a predetermined diameter, but such an inconvenience can be prevented according to the present invention.

DESCRIPTION OF THE PREFERRED EMBODIMENT

The present invention will be described in detail by referring to embodiments shown in the accompanying drawings.

Figure 1:
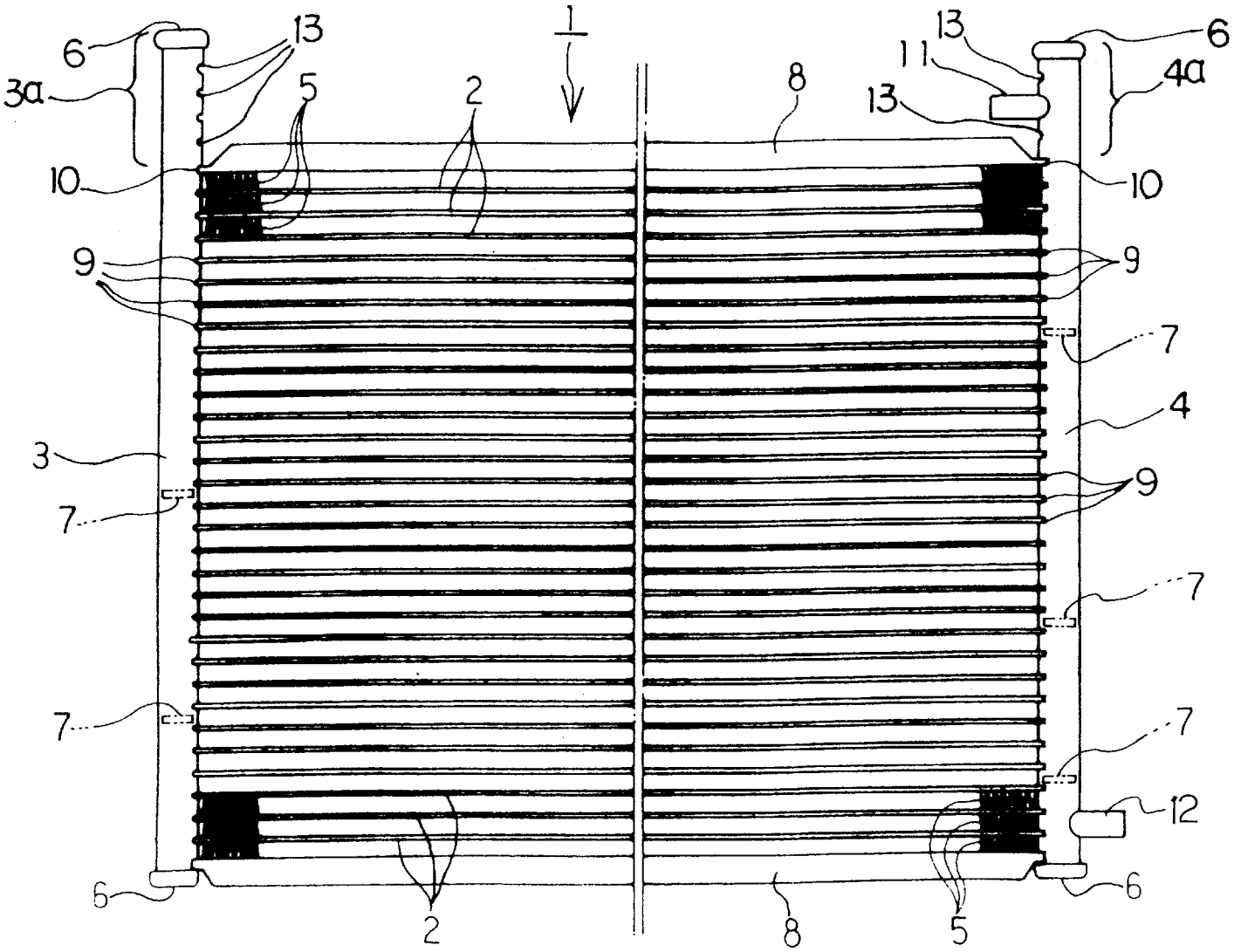
FIG. 1 is a front view of a heat exchanger with the header pipe according to the present invention.

In FIG. 1, a heat exchanger 1 according to the present embodiment comprises a pair of header pipes 3 and 4, a plurality of parallelly laminated equally long flat tubes 2, 2, the tubes being disposed between the header pipes, corrugated fins 5 interposed between the laminated tubes, and tube insertion holes 9 formed in each of the header pipes 3 and 4 for insertion of both ends of each flat tube inserted thereinto. The header pipe 4, one of the pair of header pipes, is provided with an inlet joint 11 for introducing a heat exchange medium from outside and an outlet joint 12 for discharging the introduced heat exchange medium. Both the upper and lower ends of each of the header pipes 3 and 4 are closed with caps 6 respectively, and the inside of each of the header pipes is divided by partitions 7. In the drawing, reference numeral 8 denotes side plates disposed on the top and bottom of the laminated flat tubes 2. The ends of the side plates 8 are respectively inserted into side plate insertion holes 10 formed in the header pipes 3 and 4. The side plates 8 maintain the structural strength of the heat exchanger 1 by supporting opposite two outermost corrugated fins 5 and maintaining the spaces between the laminated flat tubes 2 and the distance between the header pipes 3 and 4.

The heat exchange medium introduced through the inlet joint 11 is distributed and collected by each of the header pipes 3 and 4. The heat exchange medium circulates by meandering a plurality of times between the header pipes 3 and 4 while passing through the flat tubes 2, which are divided into predetermined groups, and is discharged through the outlet joint 12. During this process, the medium makes heat exchange while passing through the flat tubes 2.

Further, the header pipes 3 and 4 have extended portions 3*a* and 4*a* respectively, each extending in a longitudinal direction from the portion of each header pipe having the tube insertion holes 9. In this embodiment, according to the specifications of the piping, said inlet joint 11 is provided on the extended portion 4*a* of one header pipe 4, while said outlet joint 12 is provided on the back of the portion where tube insertion holes 9 are provided and adjacent to lower end of the header pipe 4.

Further, the other header pipe 3 is consisting of the same members as that of the header pipe 4 having the inlet joint 11, and has an extended portion 3*a* similar to the extended portion 4*a* of the header pipe 4. In other words, in this embodiment, the cost of manufacturing the members of the heat exchanger 1 and the cost of manufacturing equipment and installations can be reduced by using the common members for the header pipes 3 and 4.

Further, a plurality of beads 13 are formed with the extended portions 3*a* and 4*a* respectively. These beads 13, 13 not only prevent the deformation but also increase the pressure resistance of the extended portion 3*a* of the header pipe 3 and the extended portion 4*a* of the header pipe 4, which are formed by bending the header pipe material.

Figure 2:
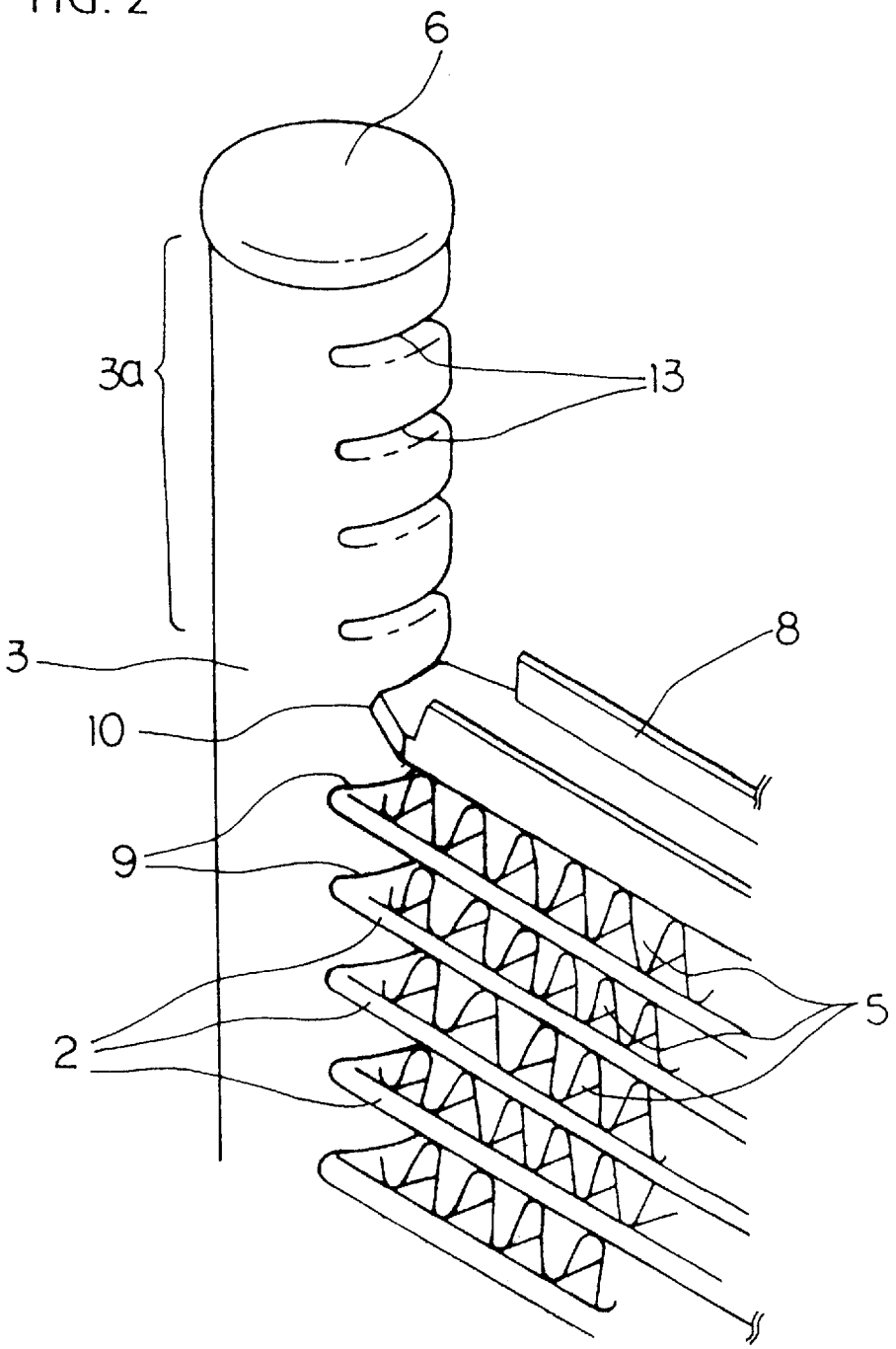
FIG. 2 is a perspective view of the extended portion of the header pipe according to the present invention.

FIG. 2 is a perspective view showing the extended portion 3*a* of the header pipe 3. As shown in the drawing, the header pipe 3 is extended longitudinally from the portion where the tube insertion holes 9 are formed, and the extended portion 3*a*, ranging from the side plate insertion hole 10 to its top with a cap 6 fitted thereto, is formed with a plurality of beads 13, 13.

Figure 3:
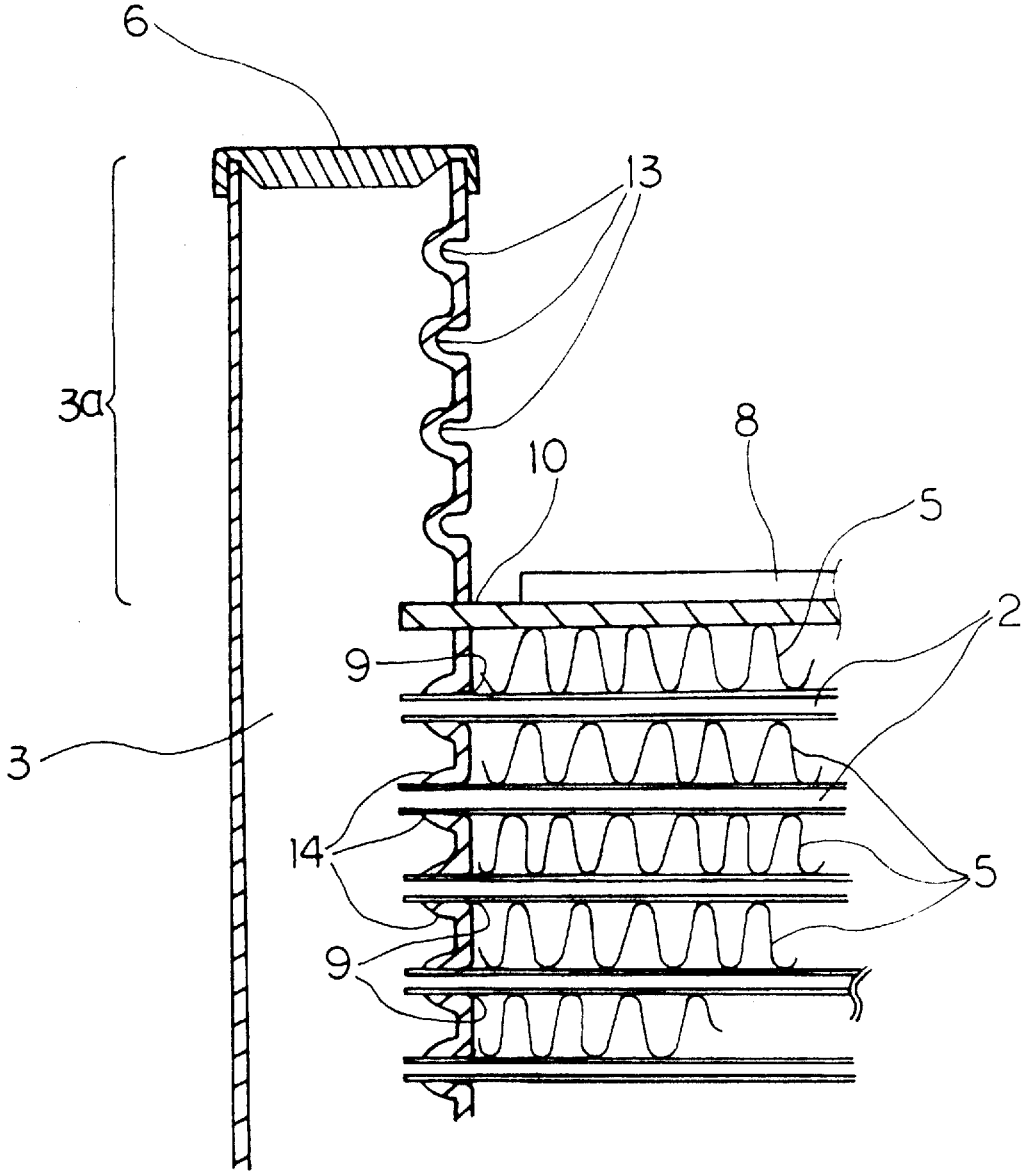
FIG. 3 is a cross-sectional view of the extended portion of the header pipe according to the present invention.

These beads 13, as shown in FIG. 3, are of concave form projecting towards the inside of the header pipe 3, these beads being arranged in line with the tube insertion holes 9, into which the flat tubes 2 are inserted respectively, and being pitched equally with the pitch of the tube insertion holes 9. In other words, the beads 13, 13 are formed at intervals equal to those of the tube insertion holes 9, 9. Further, the side plate insertion hole 10 is located between the group of tube insertion holes 9 and the group of beads 13.

Further, in this embodiment, each of the beads 13 has a width substantially equal to the opening width of the tube insertion hole 9. Further, in the drawing, reference numeral 14 denotes burrings for increasing the soldering area between the tube insertion hole 9 and the end of the flat tube 2. This burring 14 is formed projecting into inside from the edge of the tube insertion hole. In the case of this embodiment, an amount of the inward projection of the bead 13 is equal to that of the projection of the burring 14.

The portion where the tube insertion holes 9 are formed is reinforced with the ends of the tube 2 inserted into the tube insertion holes 9 and the burrings 14. Further, the extended portion 3*a* is reinforced by the beads 13. That is, the strength of the extended portion 3*a* is secured by the beads to prevents its deformation or rupture.

Further, the header pipe 3 is reinforced throughout its overall length including the portion where the tube insertion holes 9 are formed and to the extended portion 3*a*, so that the header pipe 3 can be formed from a material whose thickness is relatively thinner than those of the conventional header pipes.

Further, the beads 13 being spaced equally as the intervals of tube insertion holes 9, 9, the extended portion 3*a* is reinforced at equal intervals as the portion where tube insertion holes 9 are formed. Further, in the case of this embodiment, each of the beads 13 is not only shaped similar to the shape of each tube insertion hole 9 but also made to have the dimension of inward projection substantially equal to the dimension of the projection of the burring. As a result, the header pipe comprises the portion where the tube insertion holes 9 are formed and the extended portion 3*a* having substantially equal strengths.

Figure 4:
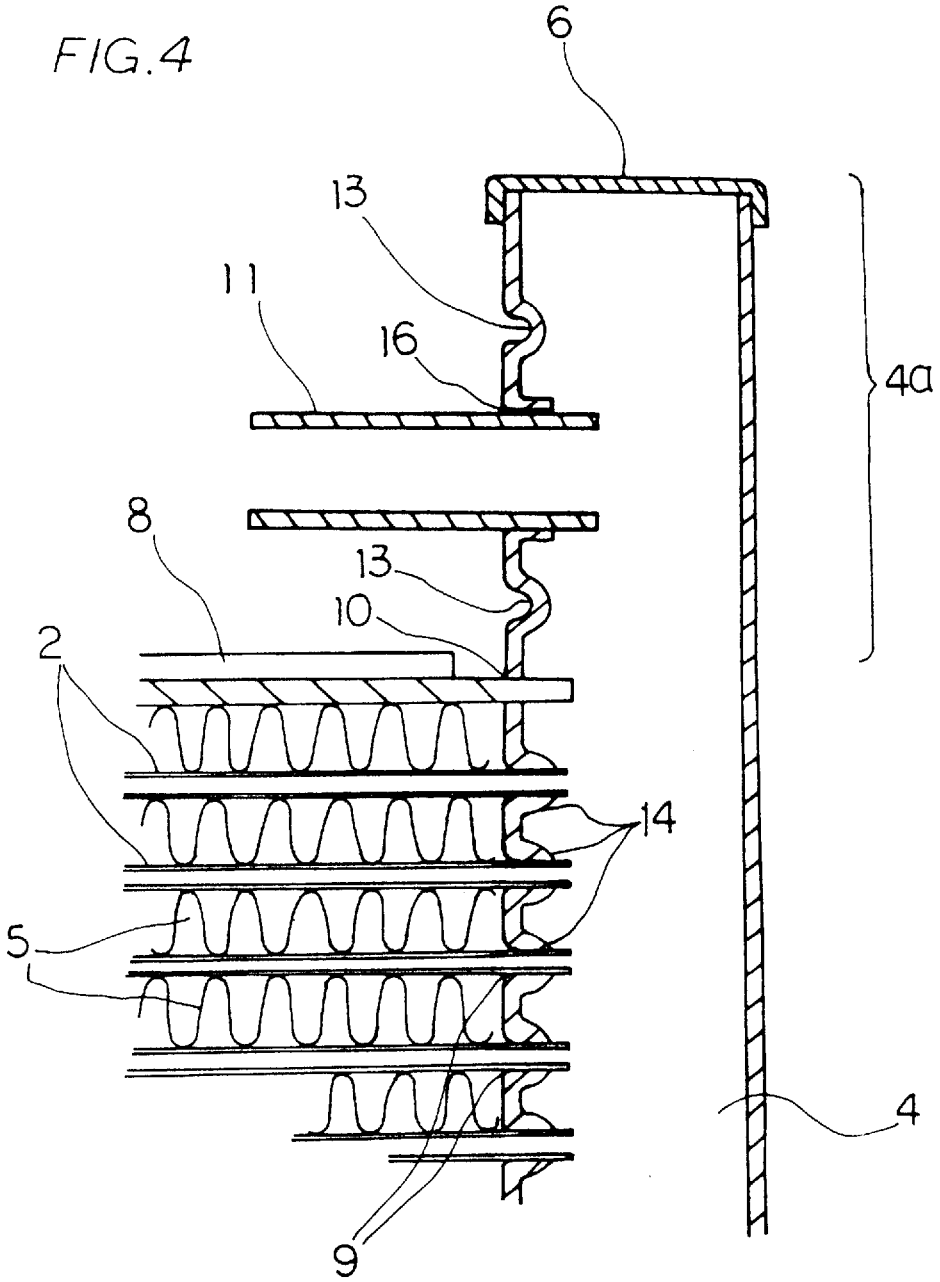
FIG. 4 is a cross-sectional view of the extended portion of the header pipe according to the present invention.

FIG. 4 is a cross-sectional view showing the extended portion 4*a* of the header pipe 4. The descriptions of the tube insertion hole 9, the side plate insertion hole 10 and the form of bead 13 are omitted here, since they are similar to those of the header pipe 3.

The inlet joint 11 is connected to an inlet joint hole 16 formed in the extended portion 4*a*. The extended portion 4*a* is reinforced by being connected to the inlet joint 11, and the beads 13 are formed in the longitudinal direction thereof. That is, the individual beads 13 are provided in longitudinal direction at intervals same as those of the tube insertion holes 9, 9. As a result, the extended portion 4*a* with the inlet joint 11 and the bead 13 are reinforced as equally as the portion where the tube insertion holes 9 are provided.

As described above, the extended portion with other members connected thereto can be reinforced as equallyaas the portion provided with the tube insertion holes by being provided with the beads 13, 13 pitched as equally as the tube insertion holes 9, 9.

Next, the process of the formation of the header pipe 3 is described. The other header pipe 4 is identical with the header pipe 3 except that it is provided with the inlet joint hole 16 for connecting the inlet joint 11, and thus the description is made only as to the header pipe 3.

Figure 5:
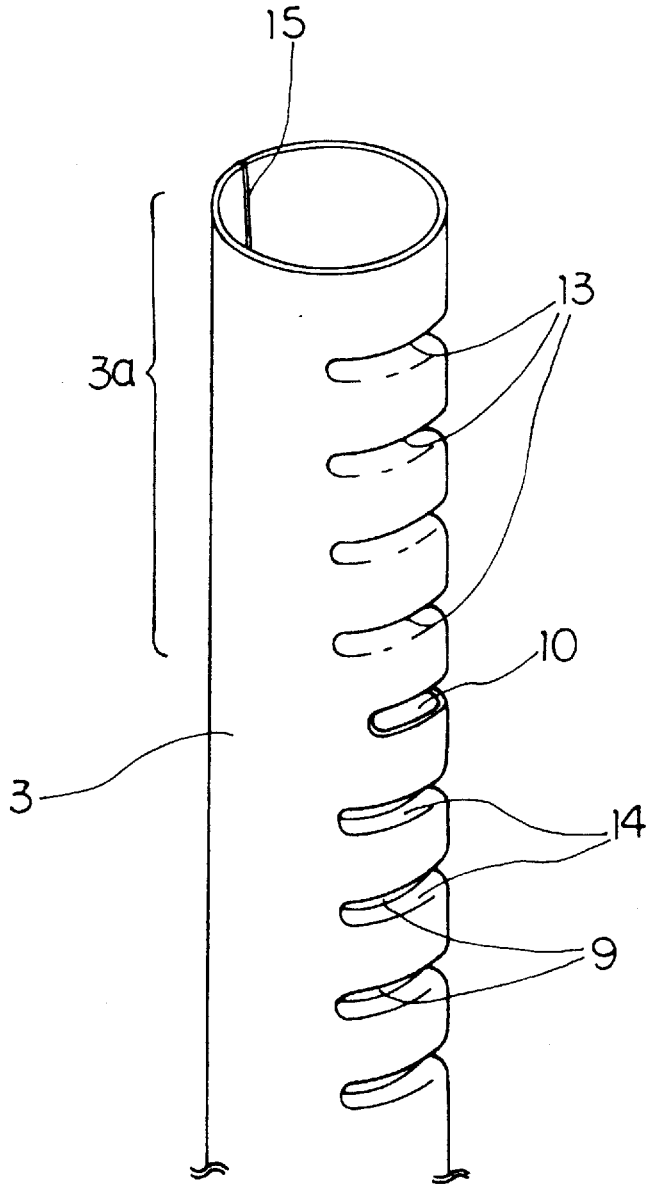
FIG. 5 is a perspective view of the header pipe according to the present invention.

FIG. 5 is a perspective view showing the header pipe 3. The header pipe 3 is formed by shaping a flat sheet material of the header pipe into a cylindrical form. In the drawing, reference numeral 15 denotes a butt joint seam of the longitudinal edges of the header pipe material.

As for the material of the header pipe, an aluminum brazing sheet clad with a brazing material is used, and the seam 15 is joined by a heat treatment and brazing.

In the above heat treatment, not only the seam 15 but also the contact area between the tube insertion hole 9 and the end of tube 2 inserted are brazed. Further, the cap 6, the side plate 8 and the like are brazed at the same time.

Figure 6:
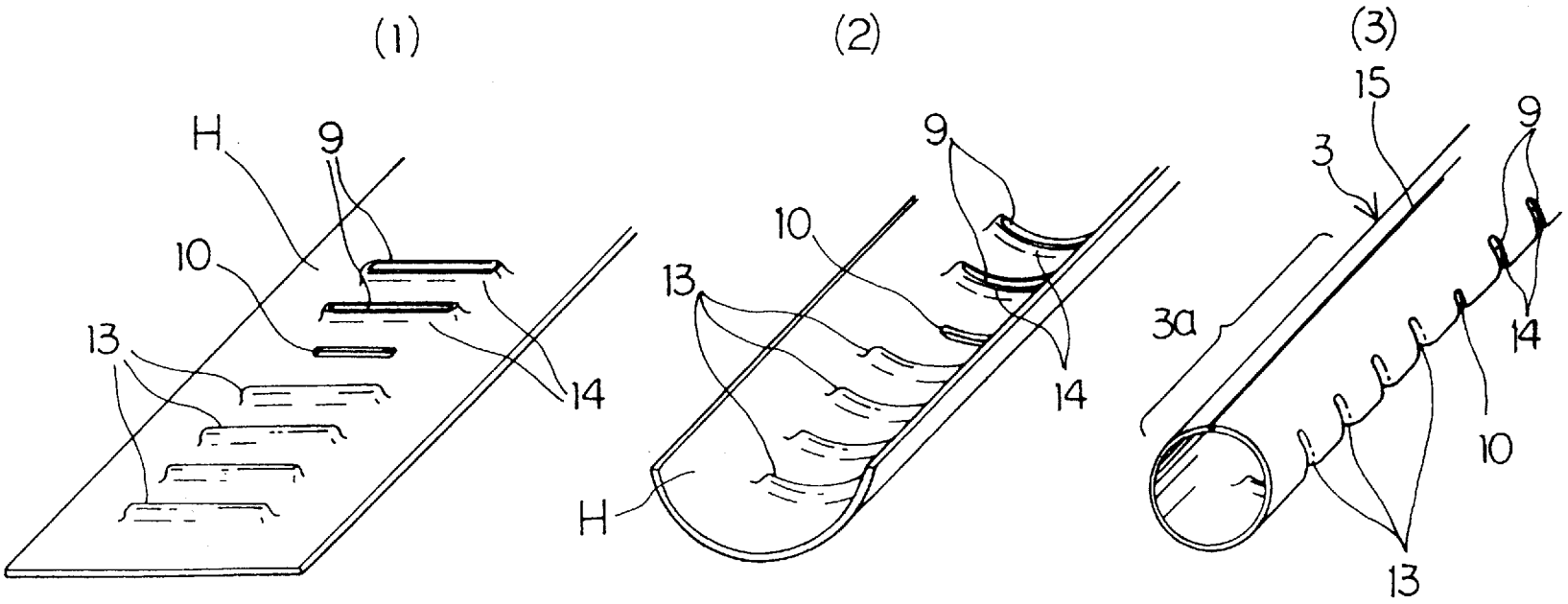
FIG. 6 is a perspective view illustrating the process steps for forming the cylindrical header pipe according to the present invention.
Figure 7:
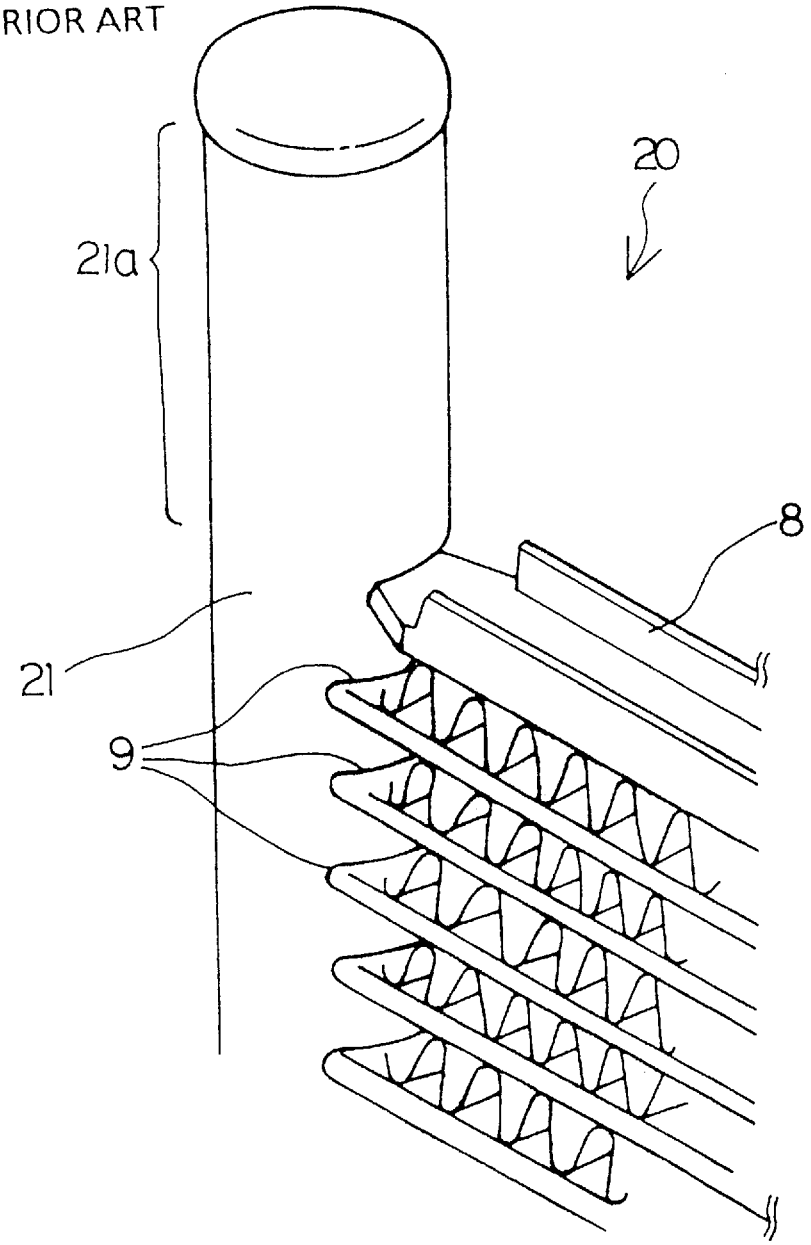
FIG. 7 PRIOR ART
FIG. 7 is a perspective view showing the extended portion of a conventional header pipe.

FIGS. 6 (1) through (3) are perspective views respectively showing the stages of process for shaping the header pipe material into a cylindrical form having a predetermined diameter.

First, as shown in FIG. 6 (1), a header pipe material H is provided with the tube insertion holes 9, each with previously provided burring 14, the side plate insertion hole 10 and beads 13. However, in the case of the header pipe 4, connection holes for connection of the inlet joint 11 and the outlet joint 12 are also formed.

Next, as shown in FIG. 6 (2), the header pipe material H is shaped into a cylindrical form having a predetermined diameter by joining its longitudinal edges with each other.

Then, as shown in FIG. 6 (3), the opposite edges of the material are joined with each other forming the seam 15 to form a cylindrical header pipe 3.

Spring back, occurring while shaping the header pipe material H into the cylindrical form, is prevented by the burring 14 for the portion where the tube insertion holes 9 are provided, and the same is prevented by the beads 13 within the extended portion 3*a*.

That is, the spring back causing the separation of the seam 15 can be prevented according to this embodiment. In other words, according to this embodiment, the separation of the seam causing the failure of brazing and resulting failure of cap fitting can be prevented in the case of the extended portion 3*a* unlike the conventional cases.

As described in the foregoing, in the case of the header pipe for the heat exchanger according to this embodiment, the extended portion is reinforced by being provided with beads, thereby preventing it from being deformed or ruptured. Further, the thickness of the header pipe material to form the header pipe can be reduced.

Further, with the beads formed at the intervals same as those of the tube insertion holes, the extended portion can be reinforced as equally as the portion provided with the tube insertion holes.

Furthermore, by forming the header pipe by shaping it into a cylindrical form, the header pipe material provided with the tube insertion holes coupled with burrings and the beads, the seam of the extended portion can be prevented from separating due to spring back when the header pipe material is being shaped into a cylindrical form having a predetermined diameter.

As described in the foregoing, according to the present invention, each of the header pipes of the heat exchanger is provided with a plurality of longitudinally formed tube insertion holes for allowing the insertion of the ends of the tubes, and is also provided with its extended portion extending longitudinally from the portion where the tube insertion holes are formed, the extended portion being provided with the reinforcing beads. Thus, the extended portion can be prevented from being deformed or ruptured by being reinforced with the beads. Furthermore, the thickness of the material forming the header pipe can be prevented from becoming thicker than necessary.

Further, since the beads have a width substantially equal to the width of opening of each tube insertion hole and pitched at intervals substantially equal to those of the tube insertion holes, the beads formed with the extended portion render reinforcing effect as equally well as rendered by the tube insertion holes, thereby providing a well balanced strength throughout to prevent the deformation or rupture of the header pipe.

Especially, when the present invention is applied for the header pipe formed into a pipe having a predetermined diameter by shaping the header pipe material, it is possible to prevent the problem of separation of the seam of the extended portion caused by the spring back occurring while the header pipe material is being shaped into a cylindrical form having a predetermined diameter.

What is claimed is:

1. Header pipes for a heat exchanger, each header pipe having a plurality of spaced apart insertion holes formed in a longitudinal direction for insertion of tube ends, characterized in that each header pipe has an extended portion extending longitudinally from a portion wherein the insertion holes are formed, and the extended portion is provided with reinforcing beads.

2. Header pipes for a heat exchanger according to claim 1, wherein each of said beads has a width substantially equal to an opening width of each of said tube insertion holes, and the beads are disposed spaced apart from one another at intervals substantially equal to intervals of the tube insertion holes.

3. Header pipes for a heat exchanger according to claim 1, wherein a flat-sheet header pipe material is formed into a pipe having a predetermined diameter.

* * * * *